US006439859B1

(12) United States Patent
de Matthaeis et al.

(10) Patent No.: US 6,439,859 B1
(45) Date of Patent: Aug. 27, 2002

(54) HIGH-PRESSURE PUMP FOR FEEDING FUEL TO AN INTERNAL COMBUSTION ENGINE

(75) Inventors: Sisto Luigi de Matthaeis, Modugno; Domenico Maldera, Corato, both of (IT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/608,381

(22) Filed: Jun. 30, 2000

(30) Foreign Application Priority Data

Jul. 2, 1999 (IT) ..... TO99A0574

(51) Int. Cl.[7] ..... F04B 27/04
(52) U.S. Cl. ..... 417/273; 417/470
(58) Field of Search ..... 417/470, 273, 417/571

(56) References Cited

U.S. PATENT DOCUMENTS 6,139,284 A * 10/2000 Streicher ..... 417/273
6,173,965 B1 * 1/2001 Niessen ..... 277/584

* cited by examiner

*Primary Examiner*—Charles G. Freay
(74) *Attorney, Agent, or Firm*—Merchant & Gould P.C.

(57) ABSTRACT

The pump has a body in which at least one cylinder for a piston is fixed by a head having a surface facing a corresponding surface of the body. The head has an intake conduit having an inlet at the surface of the head, and the body has a feed conduit having an outlet located at the surface of the body and at the inlet. Between the surfaces, a first seal is placed about the cylinder, and a second seal about the inlet. The seals are separate and made of elastomeric material. One of the seals is housed inside a circular depression in the seat of the cylinder, so as to engage the lateral surface of the cylinder.

10 Claims, 2 Drawing Sheets

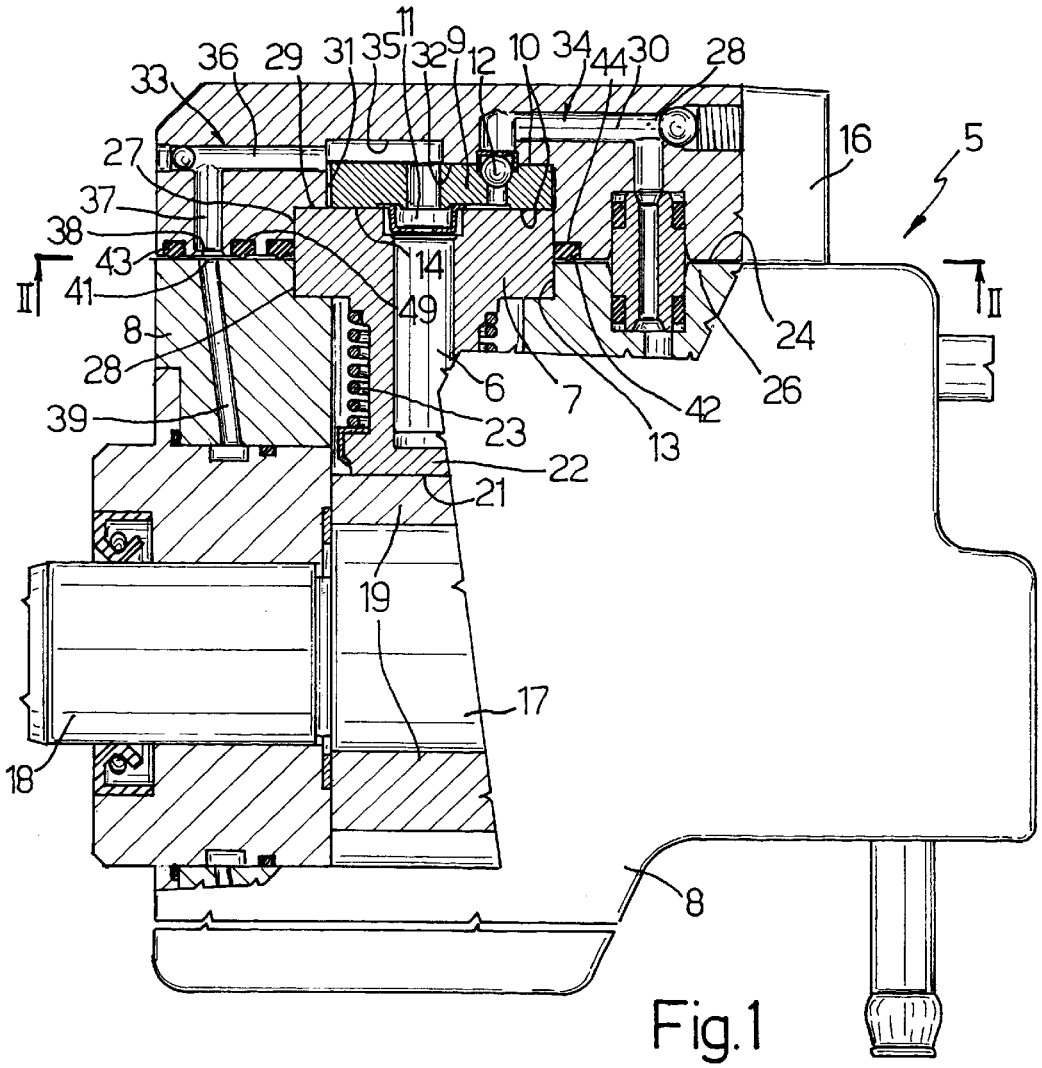
Fig.1
Fig. 2
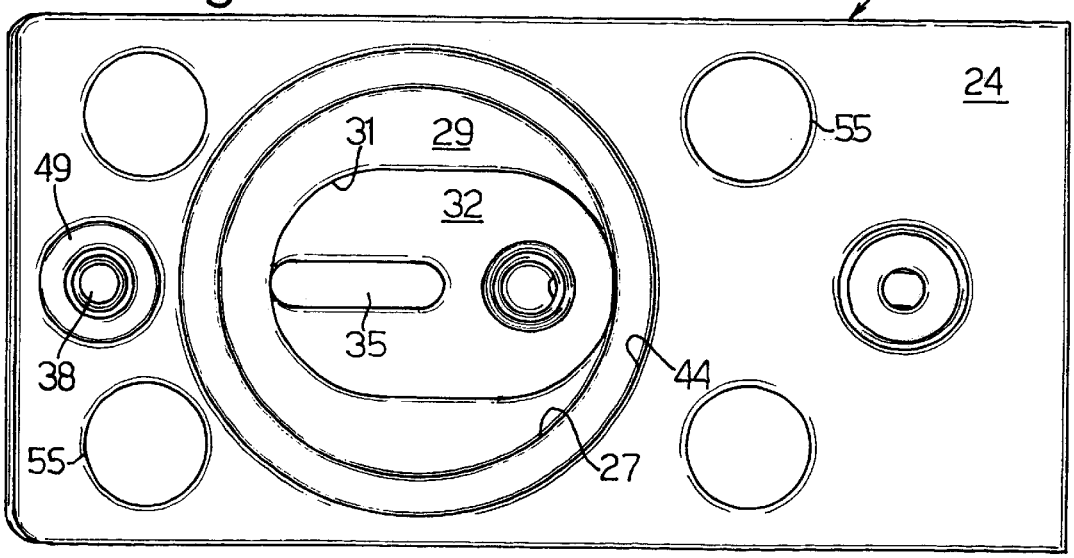

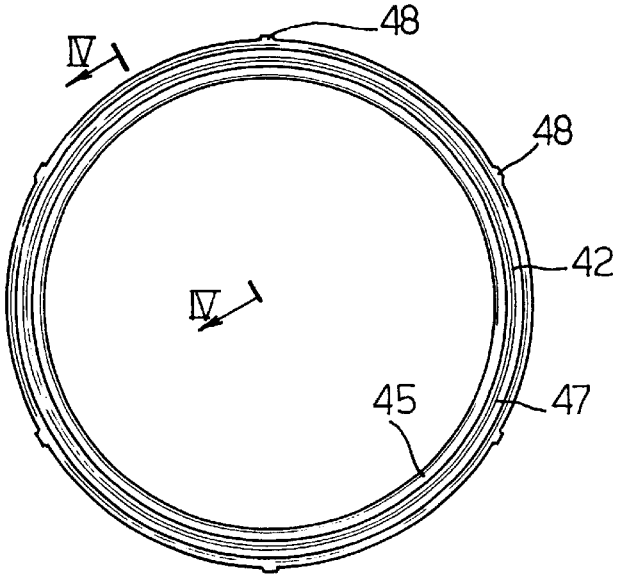
Fig.3
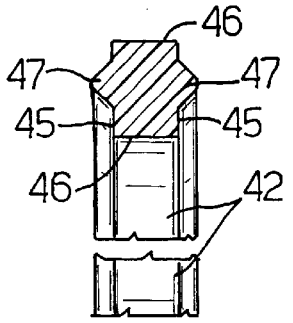
Fig.4
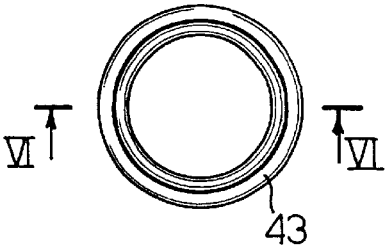
Fig.5
Fig.7
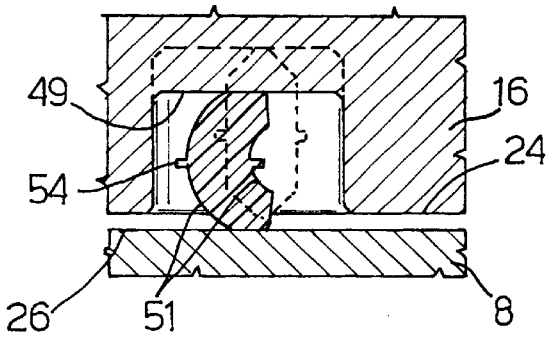
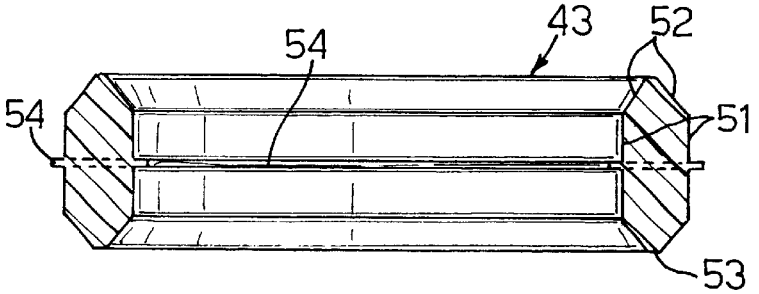
Fig.6

HIGH-PRESSURE PUMP FOR FEEDING FUEL TO AN INTERNAL COMBUSTION ENGINE

The present invention relates to improvements to a high-pressure pump for feeding fuel to an internal combustion engine, in particular a vehicle engine.

BACKGROUND OF THE INVENTION

High-pressure pumps of the above type normally comprise a body housing at least one cylinder in which a piston slides; and a head having a surface engaging a corresponding surface of the body to fix the cylinder. The head also has an intake conduit, the inlet of which is located at the head surface next to the cylinder seat.

In one known radial-cylinder pump, each cylinder is fixed by a corresponding head; a single seal of elastomeric material is inserted between the surface of each head and the body surface, and comprises an arc-shaped portion of a given diameter, which fits about the cylinder, and a smaller-diameter arc-shaped portion, which fits about the intake conduit inlet; and the section of the seal is normally elongated in a direction parallel to the head surface.

A major drawback of the above known pump lies in the seal stretching when subjected to high temperature. At pump temperatures of over 140° C., in particular, the seal tends to close at the connecting regions of the two arc-shaped portions, thus possibly choking or closing the inlet of the intake conduit. Moreover, since the choking effect differs from one cylinder to another, both activation and delivery of the pump are unbalanced, thus resulting in possible damage to the pump and in irregular supply to the engine.

SUMMARY OF THE INVENTION

It is an object of the present invention to provide straightforward, reliable improvements to the seals of a high-pressure pump, to eliminate the aforementioned drawbacks typically associated with known pumps.

According to the present invention, there is provided a high-pressure pump for feeding fuel to an internal combustion engine, and which comprises a body housing at least one cylinder in which a piston slides, and a head having a mating surface facing a corresponding mating surface on said body to fix said cylinder; said head having an intake conduit and a delivery conduit; said intake conduit having an inlet located at the mating surface of said head; and said body having a feed conduit having an outlet located at the mating surface of said body and at said inlet; characterized in that, between said mating surfaces, a first seal is placed about said cylinder, and a second seal about said inlet; said seals being separate and made of elastomeric material.

BRIEF DESCRIPTION OF THE DRAWINGS

A preferred, non-limiting embodiment of the invention will be described by way of example with reference to the accompanying drawings, in which:

FIG. 1 shows a partly sectioned view of a high-pressure pump incorporating the improvements according to the invention;

FIG. 2 shows a larger-scale view, along line II—II in FIG. 1, of a head on the pump;

FIG. 3 shows a plan view of a first seal of the FIG. 1 pump;

FIG. 4 shows a larger-scale partial section along line IV—IV in FIG. 3;

FIG. 5 shows a plan view of a second seal of the FIG. 1 pump;

FIG. 6 shows a larger-scale partial section along line VI—VI in FIG. 5;

FIG. 7 shows the FIG. 6 section in use.

DETAILED DESCRIPTION OF THE INVENTION

Number 5 in FIG. 1 indicates as a whole a high-pressure pump for feeding fuel to an internal combustion engine, e.g. of a vehicle. Pump 5 is of the type comprising three radial pistons 6 sliding inside three cylinders 7 arranged radially inside a hollow body 8; and each cylinder 7 is closed at the top by a substantially oval plate 9.

Plate 9 has two flat parallel surfaces 10, and supports an intake valve 11 coaxial with cylinder 7, and a delivery valve 12 eccentric with respect to cylinder 7. Each cylinder 7 has a cylindrical lateral surface 13 defined by a flat surface 14 engaging one of flat surfaces 10 of plate 9; and each cylinder 7 and respective plate 9 are locked to body 8 by a corresponding lock head 16 fitted removably to body 8.

Pistons 6 are activated in sequence by a single cam 17 integral with a shaft 18 activated by the internal combustion engine drive shaft; cam 17 acts on pistons 6 via a ring 19 having, for each piston 6, a faced portion 21 cooperating with a shoe 22 fixed to piston 6; and each shoe 22 is pushed towards cam 17 by a corresponding compression spring 23.

Each head 16 comprises a preferably flat mating surface 24 facing a corresponding flat mating surface 26 of body 8; and a cylindrical seat 27 (see also FIG. 2) for housing a portion of cylinder 7 defined by lateral surface 13. Body 8 comprises a further cylindrical seat 28 for housing the rest of cylinder 7 defined by surface 13; seat 27 comprises a flat surface 29 in which is formed a depression 31 forming an oval seat for housing corresponding plate 9; and a flat surface 32 of depression 31 engages the other of flat surfaces 10 of plate 9.

Each head 16 has an intake conduit 33 and a delivery conduit 34; intake conduit 33 comprises a portion defined by a groove 35 in surface 32; groove 35 is closed at the bottom by plate 9, and is aligned with a portion 36 of conduit 33 perpendicular to the axis of cylinder 7; and conduit 34 comprises a portion 30 also perpendicular to the axis of cylinder 7.

Intake conduit 33 also comprises a portion 37 parallel to the axis of cylinder 7, and which has an inlet 38 located at surface 24 of head 16; and body 8 comprises a feed conduit 39 having an outlet 41 located at surface 26, and which is positioned, in use, at inlet 38.

According to the invention, between surface 24 of head 19 and surface 26 of body 8, a first seal 42 is fitted about cylinder 7, and a second seal 43 is fitted about inlet 38 of conduit 33 and outlet 41 of conduit 39. Seals 42 and 43 are separate and made of elastomeric material.

Seal 42 (see also FIG. 3) is annular and housed in a circular depression 44 formed in surface 24 of head 16, adjacent to seat 27, so that seal 42 engages both flat surface 26 of body 8 and cylindrical surface 13 of cylinder 7.

Seal 42 (FIG. 4) has a substantially rectangular section with two major sides 45 perpendicular to, and two minor sides 46 parallel to, the axis of seal 42. The surfaces of seal 42, whose section forms the two major sides 45, each have a convex rib 47 of a thickness ranging between ⅓ and ¼ of the minor side 46 of the section; and the cylindrical surface forming the outer side 46 of the section has a number of small projections 48 (FIG. 3) for preventing seal 42 from rotating inside depression 44.

Seal 43 (FIGS. 1 and 5) is also annular but smaller in diameter than seal 42, and is housed inside a circular groove 49 formed in surface 24 of head 16 and concentric with inlet 38. Groove 49 is completely separate from depression 44 to prevent seals 42 and 43 contacting each other.

Seal 43 has an oblong section with a major axis parallel to the axis of seal 43 (FIG. 6) and perpendicular to surface 24 of head 16. The oblong section is substantially hexagonal, and comprises two major sides 51 parallel to each other and to the major axis of the section, so that each of sides 51 defines the section of a corresponding cylindrical wall. The oblong section also comprises two pairs of sides 52 at an angle to each other and connected by a fillet 53; and the cylindrical surface corresponding to each side 51 has a central annular reinforcing rib 54.

To assemble the pump, cylinder 7, together with piston 6 and spring 23, is first inserted inside seat 28 in body a (FIG. 1); plate 9, together with valves 11 and 12, is then inserted inside oval depression 31 in head 16; seals 42 and 43 are inserted inside depression 44 (see also FIG. 2) and groove 49 respectively; and, finally, head 16 is fitted to body a by means of screws inserted inside corresponding seats 55 on head 16.

The screws are tightened so that surface 10 of plate 9 engages flat surface 14 of cylinder 7, and seals 42 and 43 are compressed against flat surface 26 of body 8. Seal 42 tends to deform radially and is forced against surface 13 of cylinder 7. Seal 43 (FIG. 7), on the other hand, is (deformed so that the two major sides (51) of the section arc into a C shape, with the concavity of the deformed section facing the axis of seal 43, thus greatly improving sealing performance.

Tests have shown that, for a given pressure in feed conduit 39, the volumetric efficiency of the pump is greatly improved with respect to a known pump featuring a common seal for the cylinder and the intake conduit.

As compared with known pumps, the advantages of the high-pressure pump according to the invention will be clear from the foregoing description. In particular, deformation of seals 42 and 43 is prevented from clogging intake conduit 33; seal 42 seals the entire cylindrical surface 13 of cylinder 7; and the in-service shape of the section of seal 43 ensures effective sealing of the connection between conduit 39 of body 8 and conduit 33 of head 16.

Clearly, changes may be made to the pump as described herein without, however, departing from the scope of the accompanying Claims. For example, the pump may comprise only one cylinder 7 or a number of in-line cylinders; plate 9 may be dispensed with and valves 11 and 12 located directly on head 16; at least one of seats 44 and 49 of seals 42 and 43 may be formed wholly or partly in flat surface 26 of body 8; and seal 43 may have an oblong section other than that shown in FIG. 6.

What is claimed is:

1. A high-pressure pump for feeding fuel to an internal combustion engine, and which comprises a body (8) housing at least one cylinder (7) in which a piston (6) slides, and a head (16) having a mating surface (24) facing a corresponding mating surface (26) on said body (8) to fix said cylinder (7); said head (16) having an intake conduit (33) and a delivery conduit (34); said intake conduit (33) having an inlet (38) located at the mating surface (24) of said head (16); and said body (8) having a feed conduit (39) having an outlet (41) located at the mating surface (26) of said body (8) and at said inlet (38); characterized in that, between said mating surfaces (24, 26), a first annular seal (42) is placed about said cylinder (7), and a second annular seal (43) about said inlet (38); said seals (42, 43) being separate and made of elastomeric material.

2. A high-pressure pump for feeding fuel to an internal combustion engine, comprising at least one cylinder in which a piston slides, a body housing said cylinder, and a head having a mating surface facing a corresponding mating surface on said body to fix said cylinder on said body, said cylinder comprising a lateral surface engaging a seat in said head and a seat in said body, said head having an intake conduit and a delivery conduit, said intake conduit having an inlet located at the mating surface of said head, and said body having a feed conduit provided with an outlet located at the mating surface of said body to face said inlet, wherein the improvement includes a first annular seal of elastomeric material housed inside a circular depression formed in at least one of said mating surfaces and placed about said cylinder, said circular depression being so located as to enable said first seal to engage said lateral surface, and a second annular seal of elastomeric material housed inside a circular groove formed in at least one of said mating surfaces and concentric with said inlet, said annular seals being separated from each one.

3. A high-pressure pump as claimed in claim 2, characterized in that said first seal (42) has a substantially rectangular section with two major sides (45) perpendicular to the axis of said first seal (42); each of said major sides (45) having a rib (47) of a thickness ranging between ⅓ and ¼ of the minor side (46) of said section.

4. A high-pressure pump as claimed in claim 3, characterized in that said first seal (42) has a cylindrical outer surface having a number of projections (48) for preventing said first seal (42) from rotating in said depression (44).

5. A high-pressure pump as claimed in claim 2, characterized in that said second seal (43) has an oblong section having a major axis parallel to the axis of said second seal (43).

6. A high-pressure pump as claimed in claim 5, characterized in that said oblong section is substantially hexagonal and comprises two parallel major sides (51), and two pairs of sides (52) at an angle to each other; said major sides (51) of said oblong section being parallel to said major axis; and the sides (52) in each of said pairs being connected by a fillet (53).

7. A high-pressure pump as claimed in claim 6, characterized in that, in use, said oblong section is deformed to arc said two major sides (51) of said oblong section.

8. A high-pressure pump as claimed in claim 2, characterized in that, between said head (16) and said cylinder (7), there is inserted a plate (9) supporting an intake valve (11) and a delivery valve (12); each of said conduits (33, 34) comprising at least one portion (36, 30) perpendicular to the axis of said cylinder (7); said intake conduit (33) comprising a further portion (37) parallel to the axis of said cylinder (7) and having said inlet (38).

9. A high-pressure pump as claimed in claim 8, characterized by comprising a number of cylinders (7) arranged radially inside said body (8); and a number of pistons (6) associated with said cylinders (7) and slicing radially; each of said cylinders (7) being fixed to said body (8) by a corresponding head (16); and said body (8) comprising a feed conduit (39) associated with each of said cylinders (7).

10. A high-pressure pump as claimed in claim in 2, wherein said circular depression and said circular groove are formed both in said head, the mating surface of said body being flat, said first annular seal engaging both the flat surface of said body and lateral surface of said cylinder.

* * * * *